US005183983A

United States Patent [19]

Knop

[11] Patent Number: 5,183,983

[45] Date of Patent: Feb. 2, 1993

[54] FLOW SWITCH ASSEMBLY FOR FLUID FLOW MONITORING

[75] Inventor: David G. Knop, Chesterton, Ind.

[73] Assignee: Dwyer Instruments, Inc., Michigan City, Ind.

[21] Appl. No.: 855,213

[22] Filed: Mar. 20, 1992

[51] Int. Cl.[5] ..... H01H 35/40

[52] U.S. Cl. ..... 200/81.9 M; 73/861.76; 340/610

[58] Field of Search ..... 73/861.74, 861.75, 861.76; 340/606, 610; 307/118; 200/81.9 R, 81.9 M, 81 R, 82 E, 83 L; 335/205

[56] References Cited

U.S. PATENT DOCUMENTS

| | | | |
|---|---|---|---|
| 2,887,546 | 5/1959 | Hatfield et al. | 200/81.9 |
| 3,569,648 | 3/1971 | De Meyer | 200/81.9 M |
| 4,594,487 | 6/1986 | Grassl | 200/82 E |
| 4,791,254 | 12/1988 | Polverari | 200/81.9 M |
| 4,827,092 | 5/1989 | Kobold | 200/81.9 |

FOREIGN PATENT DOCUMENTS

| | | | |
|---|---|---|---|
| 1186300 | 4/1970 | United Kingdom | 200/81.9 M |

OTHER PUBLICATIONS

Sika Catalog, pp. 1-12, dated Apr. 1991.

W. E. Anderson Div., Dwyer Instruments, Inc., Catalog No. V6, published prior to 1990 (Model V6).

*Primary Examiner*—Gerald P. Tolin

*Attorney, Agent, or Firm*—Lee, Mann, Smith, McWilliams, Sweeney & Ohlson

[57] ABSTRACT

A basic housing for a fluid flow monitoring assembly comprising a sensing leakproof elongate hollow body formed from a non-magnetic, metallic material and pivotally mounting internally of same a vane assembly that at one end includes a vane adapted to be inserted into a fluid flow of piping, with the vane assembly being spring biased to pivot oppositely of the direction of fluid flow, about its pivot mounting, for zero or reduced fluid flow conditions, and at its other end including a permanent magnet for electrically actuating a switch mechanism; such elongate sensing body defines an open end through which the vane projects and closed a end adjacent the magnet, which elongate body adjustably mounts crosswise thereof at its closed end within the permeability of the magnet for set point adjustment purposes a novel flow switch assembly comprising a plastic housing that is also leakproof and potably mounts in hermetically sealed relation a commercially available reed type off-on switch in electrical circuit arrangement with lead wires having ends that extend from one end of such flow switch assembly, for connection in optional electrical circuiting of a variety of types, which flow switch assembly is in field adjustable and can be set so the reed switch is Normally Open or Normally Closed, with the switch assembly housing including both indicia and flanging for setting the same precisely at such Normally Open or Normally Closed positions; the switch assembly is also arranged for full removal from the unit basic housing for inspection or replacement without the need to shut down the equipment to which the monitor assembly is applied.

7 Claims, 2 Drawing Sheets

FLOW SWITCH ASSEMBLY FOR FLUID FLOW MONITORING

BACKGROUND OF THE INVENTION

This invention relates to a flow switch assembly for fluid flow switch monitoring devices, and more generally, the invention relates to a monitor device for monitoring fluid flow (both liquids and gases) in piping in which device a vane is to be inserted in the fluid flow for monitoring purposes and is moved by the force of the fluid flow, with the resulting motion being magnetically transformed into an electrical signal; in accordance with the invention, the electrical signal is provided by a novel switch assembly that includes an elongate housing formed from a suitable plastic non-magnetic material in which a reed switch is hermetically sealed in electrical circuit arrangement with lead wires having exteriorly exposed ends for connection in electrical circuiting of a variety of types, with the switch assembly being in field adjustable with respect to the monitoring device sensing body whereby the monitor assembly as a whole can be set so that the electrical switching provided is either Normally Closed (NC) or Normally Open (NO), with the switch assembly housing including both flanging and indicia for positively setting same relative to the monitoring device sensing body precisely at such Normally Open or Normally Closed positions.

Fluid flow monitors are commonly employed for application to piping for monitoring the conveying liquids and gases to equipment operated thereby. An example is the PSR Flowmonitor (See U.S. Pat. No. 4,828,092, granted Aug. 2, 1989) offered by the German firm known in the industry as Kobold, which German firm has what apparently is an American subsidiary, Kobold Instruments, Inc., of Pittsburg, Pa. Units of this type involve an elongate sensing body which houses a spring biased rocking vane assembly (called a "paddle"), which sensing body in use is suitably connected to the piping so that the vane portion (of the rockable vane assembly carried thereby) that projects from the open end of the elongate sensing body is disposed within the path of movement of the piping flowing fluid medium, with the vane assembly swinging about a center to move a switch activating magnet carried by such vane assembly within its sensing body; the portion of the sensing body exterior of the piping has a closed end exterior of the piping, adjacent the movement path of the magnet, in which is adjustably mounted a switch assembly of the conventional reed type that includes a elongatge plastic housing that mounts in hermetically sealed relation the reed switch involved in electrical circuit arrangement with lead wires that have externally disposed ends for incorporation in electrical circuiting of a type where an electrical switch function is required once a specific fluid flow is achieved. The PSR device can be set to operate as either a Normally Open (NO) or a Normally Closed (NC) switch function, by moving the reed switch housing, which thus provides adjustable "switch point".

Applicant has found in testing the Kobold PSR Unit has found that while such unit is adjustably arranged to nominally provide adjustable "switch point", the only indication for such adjustment that is available for such unit is in the form of a pair of small arrows applied to the exterior of the switch assembly housing, each indicating a Normally Open or Normally Closed switch function location of the switch assembly housing with respect to the monitor sensing body; Applicant has found, in this connection, that the arrow arrangement involved in connection with the Kobold PSR Unit does not provide the preciseness needed for this type of instrument, considering, for example, the off-hand manner in which, as a practical matter, instruments of this type are often in field set by those not really skilled in this art. Thus, the small arrows provided on such Kobold monitors leave room for individual interpretation and possible location error as there is no positive physical indication that the reed switch assembly has been located accurately to function as desired.

Accordingly, a principal object of the present invention is to provide a fluid flow switch monitoring assembly of the type indicated wherein the reed switch assembly, as mounted for adjustment laterally of the instrument sensing body, provides a positive physical indication that such switch assembly is properly located with respect to the instrument sensing body to provide the switch function desired.

A further object of the invention is to provide a fluid flow switch monitoring assembly of the type indicated wherein the reed switch assembly is formed to provide stops that engage the instrument's sensing body to provide a positive physical indication that the switch assembly is properly located with respect to the instrument's sensing body to provide the switch function desired.

Another important object of the invention is to provide a fluid flow switch monitoring assembly of the type indicated wherein the switch assembly is of the reed switch type, and the reed switch itself is precisely located within the switch assembly at the desired position for providing the Normally Closed (NC) switch function, and the switch assembly exterior is formed with projecting flanges that act as stops that on adjustment engage the instrument sensing body to provide a positive physical indication that the switch assembly of the present invention is properly located with respect to the instrument's sensing body to provide the switch function desired.

Another important object of the invention is to provide a fluid flow monitor of the type indicated wherein the reed switch that is employed in connection with the switch assembly is on the side of the switch assembly that is to be closest to the level of movement of the unit sensing body magnet, with the opposing side of such switch assembly being provided with indicia for positively indicating the position of the switch assembly relative to the unit sensing body for its Normally Closed (NC) switching function, or its Normally Open (NO) switching function, as are respectively provided by the indicated stop flanges.

Another important object of the invention is to provide a generally improved fluid flow switch monitoring assembly of the type indicated, which is surprisingly compact, solidly built, and leakproof as to the flow sensing body and switch assembly housing, and that is arranged to be in field calibrated to trigger on rising or falling flow rates (at the option of the installer), that is inexpensive of manufacture, that is easily calibrated and maintained, that is designed for long term trouble free service in critical operations, and is readily removed for inspection or replacement without shutting down the pipeline in which it is mounted.

Further in accordance with the invention, another important object is the provision of a novel but simple method of positively adjusting and setting at the desired switch point the unit switch assembly with regard to its sensing body.

In accordance with the present invention, a fluid flow switch monitoring device is provided, for application to piping for conveying liquids and gases to equipment operated thereby, comprising a sensing body to which is adjustably applied a fluid flow switch monitoring assembly that is arranged in accordance with the present invention. The monitoring device sensing body is formed from a non-magnetic material, such as brass, to define a bore or cavity extending longitudinally thereof that is open at one end thereof and is closed at the other end thereof, with the monitoring device sensing body cross mounting at its closed end an elongate off-on switch assembly for adjustment movement thereof laterally of the unit's sensing body, and with the sensing body having pivotally mounted within its bore or cavity, for pivotal movement in coplanar relation to the direction of fluid flow through the piping, a swing lever control device in the form of a vane assembly that includes at one end of same a vane projecting from the sensing body open and a permanent magnet adjacent to the other end that is disposed to the unit's sensing body closed end for effecting by magnetic action the activation of the switch device, with the basic unit including spring means mounted within the unit's sensing body for resiliently opposing such pivotal action, and with the basic unit involved including means for clamping the unit's switch device into fixed position relation with respect to the unit sensing body; pursuant to the present inventio, the unit switch assembly comprises an elongate housing formed from a suitable plastic non-magnetic material, that is shaped to define an elongate bore intermediate the ends of such housing, with a commercially available reed switch being potably mounted in the switch assembly housing bore in electrical circuit arrangement with lead wires extending from one end of the switch assembly housing, with the reed switch itself being disposed on the side of the switch housing that has a level which is closest to the path of movement of the basic unit magnet on pivotal movement of the vane assembly forming the unit lever control device (such side of the switch assembly housing hereinafter being referred to as the "switch side"); with the switch assembly housing defining first and second stop means disposed one on either side of the basic unit sensing body for engagement with the basic unit sensing body when the basic unit's switch assembly is to be positioned to provide the normal closed (NC) or Normally Open (NO) functions of the reed switch (that is mounted within the switch assembly housing), with the positioning of the indicated reed switch within the switch assembly housing being such that the reed switch is disposed longitudinally of said housing to have its Normally Closed (NC) function when the switch assembly housing first mentioned stop means physically engages the unit sensing body, and with the switch assembly housing having the side of same that is opposite of its said switch side, bearing indicia indicating such Normally Closed (NC) and Normally Open (NO) functions and corresponding to the location of said first and second stop means. Such indicia is applied to an elongate label attached to the side of the switch assembly housing that is oppposite of its "switch side", for serving to indicate when the switch assembly is disposed with respect to the unit sensing body to be positioned at one of the aformentioned switch function providing positions; the unit sensing body at its closed end is slotted thereacross in parallelism with the direction of the fluid flow that is to be monitored for slidably receiving the switch assembly housing, with the "switch side" of said switch assembly housing being disposed in the indicated slot at said critical level. The fluid flow switch monitoring device of the present invention also inclùdes a cap and a set of screw elements for clamping the switch assembly housing at the position relative to the unit sensing body that will provide the switch function desired (which is thus an option of the installer of the basic sensing device involved).

BRIEF DESCRIPTION OF THE DRAWINGS

Other object, uses, and advantages will be obvious or become apparent from consideration of the following detailed description of the application drawings, in which like reference numerals indicate like parts throughout the several views.

In the drawings.

Figure 2:
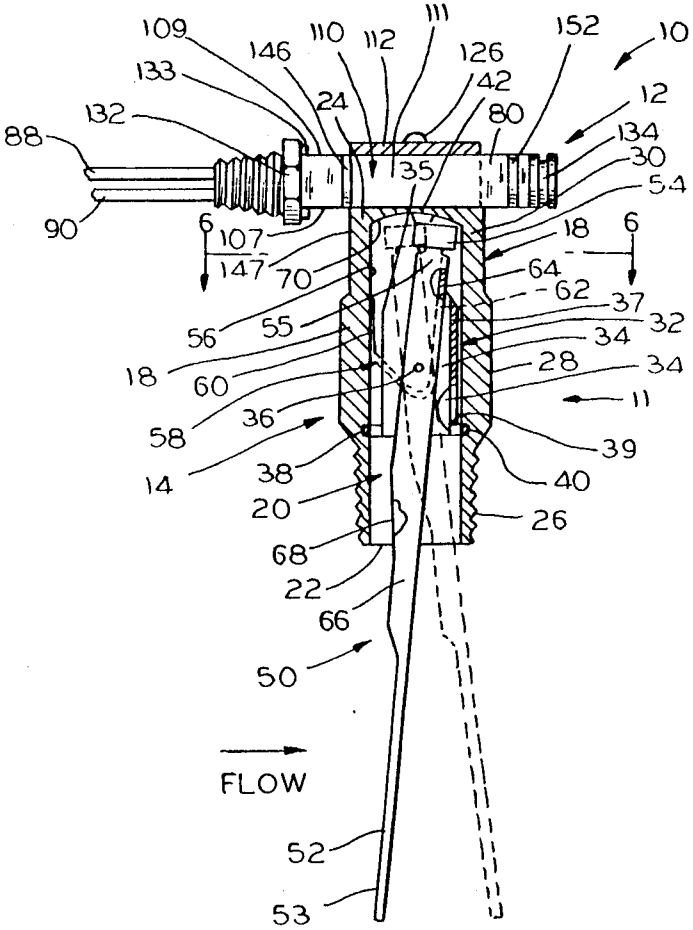
FIG. 2 is a side elevational view of the monitoring device of FIG. 1, showing in section, and on the same reduced scale, the sensing body of such device, and indicating the components mounted within same, as well as the basic unit switch assembly that is adjustably mounted at the closed end of the basic unit sensing body, with the vane assembly of the sensing body being shown in full line relation for the zero flow condition, and being shown in dashed lines at approximately the full fow rate position, and the switch assembly "set" relative to the device sensing body in the relation indicated in FIG. 1.

However, it is to be distinctly understood that the drawing illustrations referred to are provided primarily to comply with the disclosure requirements of the Patent Laws, and that the invention is susceptible of modifications and variations that will be obvious to those skilled in the art, and that are intended to be covered the appended claims.

DETAILED DESCRIPTION OF THE PREFERRED EMBODIMENT

Figure 1:
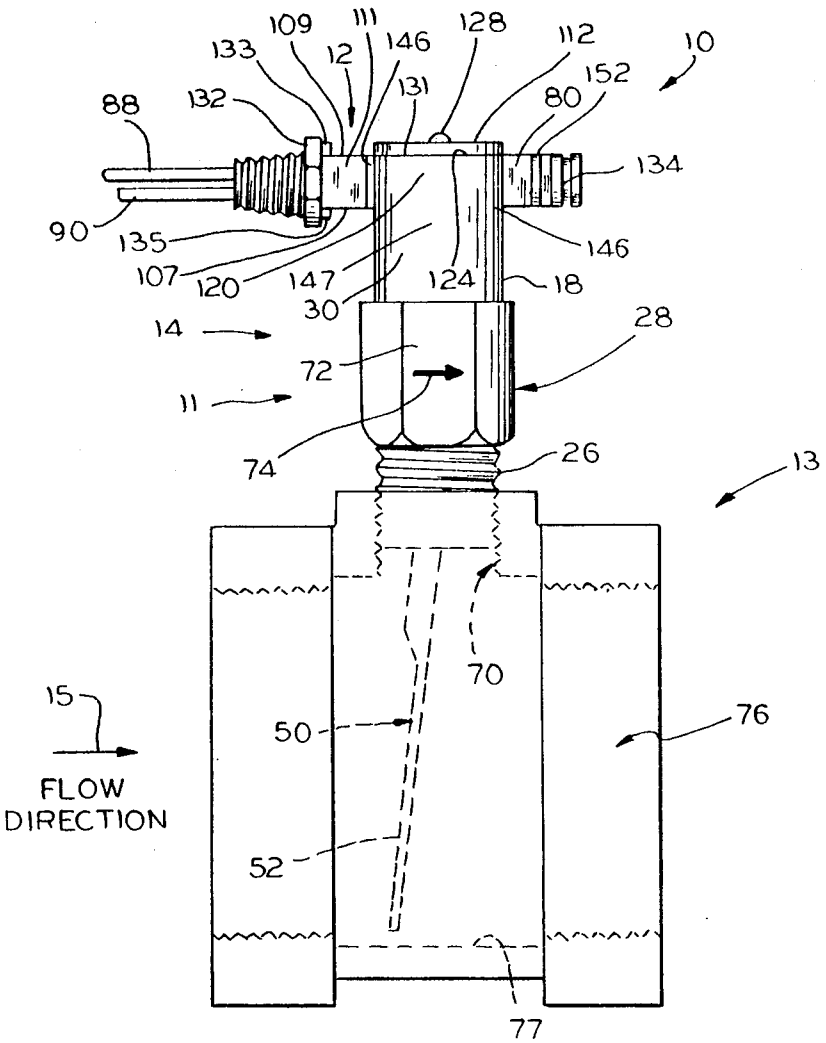
FIG. 1 is a diagrammatically illustrated, side elevational view of a preferred embodiment of the invention shown on a reduced scale, and as applied to a conventional tee connector for connecting together two lengths of conduiting (not shown as such), employed in piping of the type referred to, through which there will be fluid flow in the direction indicated by the arrows thereof that is to be monitored by the fluid flow monitoring assembly shown in FIG. 1, and controlled, utilizing the switch assembly that is a component part of the basic monitoring assembly shown in FIG. 1, and that has been "set" for this application.

Referring first to FIG. 1, reference numeral 10 indicates one embodiment of a fluid flow switch monitor device, in accordance with the present invention, which includes the basic housing 11 in the form of the hollow sensing body 14 as shown in section in FIG. 2, and the switch assembly 12 that is slidably mounted on the sensing body 14 cross-wise thereof for securement in fixed relation to the sensing body 14 to provide the Normally Closed (NC) switch function and the Normally Opened (NO) switch function, as desired by the installer. The specific monitor device 10 illustrated is shown in FIGS. 1 and 2 in one specific application, in which it is applied to a conventional Tee type pipe length connector 13 that is of the type conventionally employed to connect together two adjacent lengths of piping that are omitted as unnecessary. However, the basic monitoring device has wide application for other uses, as hereinafter disclosed.

As has been pointed out hereinbefore, fluid flow monitors are commonly employed for application to piping used to convey liquids and gases to equipment operated thereby. As to the showing of FIGS. 1 and 2, it may be assumed that the conventional Tee 76 that forms connector 13 is employed to connect two lengths of such piping together, and the direction of flow of the fluid medium through such piping and the Tee 76 is in the direction indicated by the arrow 15 of FIG. 1.

THE SENSING BODY

Figure 6:
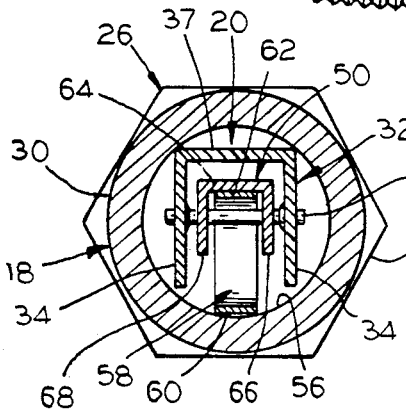
FIG. 6, is a transverse cross-sectional view approximately along line 6—6 of FIG. 2, looking in the direction of the arrows, and on an enlarged scale.

As those skilled in the art are aware, fluid flow monitors of the type to which the invention relates are disposed relative to the conduiting containing the fluid flow medium, in perpendicular relation thereto, as indicated in FIG. 1. For this purpose, the said sensing body 14 itself is basically a one-piece item formed of a suitable non-magnetic material, such as brass, and defining an elongate rigid member 18 formed with an elongate bore 20 (see FIG. 2), an open end 22, and a closed end 24. The sensing body 14 also includes externally threaded portion 26, a hex shaped portion 28, and a round portion 30 that is integral with the closed end 24 of member 18. The bore 20 has seated in same conventional three sided pivot frame 32 or bracket (see FIG. 6) defining opposing walls 34 between which pivot pin 36 is secured, and a cross wall 37 integrally connecting walls 34. The walls 34 of frame 32 at their inner ends 35 are conventionally proportioned to seat on the concave closed end surface 42 of the sensing body 14, with frame 32 being held within the body bore 20 by seating the outer end 39 of wall 37 on suitable wire clip 38 or other form of locking ring that is resiliently applied to annular recess 40 that is formed within body bore 20. The clip 38 or locking ring substitute therefor may be any one of the conventional types available for this purpose, with the frame 32 also being conventionally proportioned relative to the internal diameter of bore 20 so that friction between the frame 32 and the body 14 prevents rotation of frame 32 relative to body 14 out of the operative position shown in FIG. 2. For this purpose, the walls 34 and 37 are integrally formed from a suitable resilient metal proportioned so that it is necessary to compress frame 32 laterally of body 14 on inserting same therein, with the result that the corners and edges of pivot frame 32 bite into the internal surfacing 56 of bore 20 when frame 32 is forced into bore 20, to the position indicated in FIG. 2, for seating on clip 38 (or its equivalent).

Pivotally mounted on the pin 36 is the conventional vane assembly 50 that is basically of channel shaped configuration, as suggested in the drawings, and includes a vane portion 52 at one end and 53 thereof and a permanent magnet 54 at the opposing end 55 thereof, which magnet 54 is conveniently of the ceramic type and suitably fixed to the vane assembly 50 so as to swing therewith when the fluid flow medium engages the vane portion 52 of the assembly 50. FIG. 2 illustrates two positions of the vane assembly 50, but the parts are conventionally proportioned so that the vane assembly 50 may swing clockwise and counterclockwise to the extent that the magnet 54 engages opposite portions of the internal surfacing 56 of bore 20. Vane assembly 50 is mounted on pivot pin 36 prior to the pivot frame 32 being positioned as shown in FIG. 2.

As is conventional, the pivoting action of the vane assembly 50 is opposed by suitable vane spring 58, which in the embodiment illustrated, comprises (see FIG. 2) arm 60 lodged against the bore surfacing 56 of body 14, which arm 60 is integral with arm 62 that engages against the vane base wall 64 that connects the vane assembly side walls 66 and 68 of the assembly 50. Spring 58 is also in place when pivot frame 32 is positioned as shown in FIG. 2.

In this connection, the end wall 24 of body 14 defines concave surfacing 42 that may be shaped as indicated at 70 to have the shaping of the indicated movement of the magnet 54 under the action of the fluid medium that is monitored by the device 10, with the spring 58 acting in opposition thereto. At the extreme positions of the vane assembly 50 in either direction, the opposite ends of the magnet 54 engage the bore surfacing 56 of the body 14 as a movement stop for assembly 50. Surfacing 42 may also be concavely conical about the longitudinal axis of body 14, assuming proportioning of same that avoids interference with the indicated path of movement of magnet 54.

As is also conventional, the sensing body 14 and the novel switch assembly 12 it is equipped with to form the monitor 10 is applied to the piping (through which the fluid medium is to flow), for instance, as indicated in the showing of FIG. 1, where the conventional externally threaded portion 26 of the body 14 is turned into the internal threading 70 of the Tee 76 until the device 10 is tightly secured to the Tee 76; for this purpose, the illustrated embodiment of body 14 includes, on the appropriate face 72 of its portion 28, flow arrow 74, so that when a body 14 is tightly connected to the Tee 16 when the flow arrow 74 is pointing in the direction of the fluid flow inside the piping involved, the tightening of the body 14 in Tee 76 is to stop. Arrow 74 is applied to the indicated hex face 74, as by being formed therein, or as by being applied to a suitable label, or in any other convenient manner.

It should be noted that the vane portion 52 of vane assembly 50 is shown in broken lines in FIG. 1, it being important that the vane assembly 50 extends substantially across the bore 77 defined by the Tee 76 employed (vane portion 52 may be trimmed or extended as needed for this purpose).

It should also be noted that the application of the monitoring device 10 to the Tee 76 as shown in FIG. 1 exposes the vane assembly 50 to the fluid medium inside the piping and thus Tee 76, while the switch assembly 12 of the monitoring unit 10 is disposed exteriorly of the piping involved including the Tee 76.

It is also pointed out that the diagrammatic FIG. 1 illustrates the vane assembly 50 at rest at a no flow state. As a fluid medium flow develops in the direction indicated by the arrows 15 and 74 of FIG. 1, the vane assembly 50 pivots counterclockwise against the resiliency of spring 58 to move the magnet 54 until it contacts the opposite portion of the bore surfacing 56 of body 14. As the magnet 54 is shifted counterclockwise as shown in FIG. 2, the magnetic field accompanying same shifts correspondingly with respect to the switch assembly 12.

As indicated, the vane pivot frame 32 is proportioned relative to the internal diameter of bore 20 so that sufficient friction exists between the two to prohibit the vane assembly 50 from rotating to one said or the other from the plane of its rotation with respect to pivot pin 36, which plane preferably is in substantially coplanar relation to the direction of movement of the fluid medium through the piping and the connector Tee 76. Thus, the indicated setting of the arrow 74 of FIG. 1 also sets the movement plane of vane assembly 50 at the correct position.

THE SWITCH ASSEMBLY

The switch assembly 12, which is shown applied as in use to sensing body 14 in FIGS. 1 and 2, comprises a housing 80 (see FIGS. 3–5) formed from a suitable nonmetallic, non-magnetic material, such as a polypropylene or other plastic material compound that is molded to the internal and external configuration illustrated.

Figure 4:
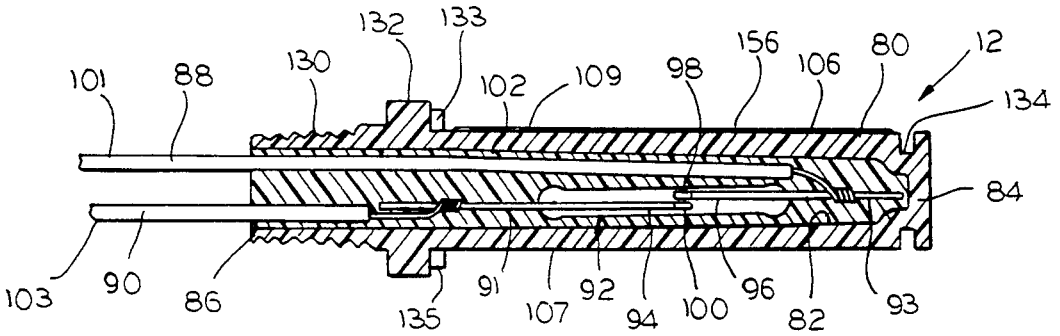
FIG. 4 is a sectional view of the switch assembly shown in FIGS. 1 through 3, taken substantially along line 4—4 of FIG. 3, to diagrammatically indicate the general arrangement involved, and to indicate the manner in which the conventional reed switch thereof should be positioned with respect to the switch assembly housing in accordance with the present invention.

The housing 80 is elongate in configuration, and defines internal bore 82 (see FIG. 4) that extends between closed end 84 and open end 86 of housing 80. As shown in FIG. 4, lead wires 88 and 90 are suitably connected (and soldered in place) to the lead ends 91 and 93 of conventional reed switch 92 that is also provided with a pair of diagrammatically illustrated internal switch arms 94 and 96 that are to be brought together by the magnetic field of magnet 54 at their respective contacts 98 and 100 to complete an electrical circuit at the electrically "closed" position of assembly 12; when such magnetic field is not present to so "close" switch arms 94 and 96, such contact arms are conventionally biased to move contacts 98 and 100 apart, which is the electrically "open" position of assembly 12. The leads 88 and 90 define the usual end portions 101 and 103 that extend exteriorly of the housing 80, with the lead wires 88 and 90 and the reed switch 92 after their indicated electrical connection during the course of manufacture of the assembly 12, being slipped into the bore 82 of the switch assembly housing 80 and then pottedly fixed in place using a suitable epoxy product compound, indicated at 102, that is suitably injected into housing bore 82.

However, a significant aspect of this invention is the location of the reed switch 92 within bore 82 of the switch assembly housing 80. This will be specifically described hereinafter.

Figure 3:
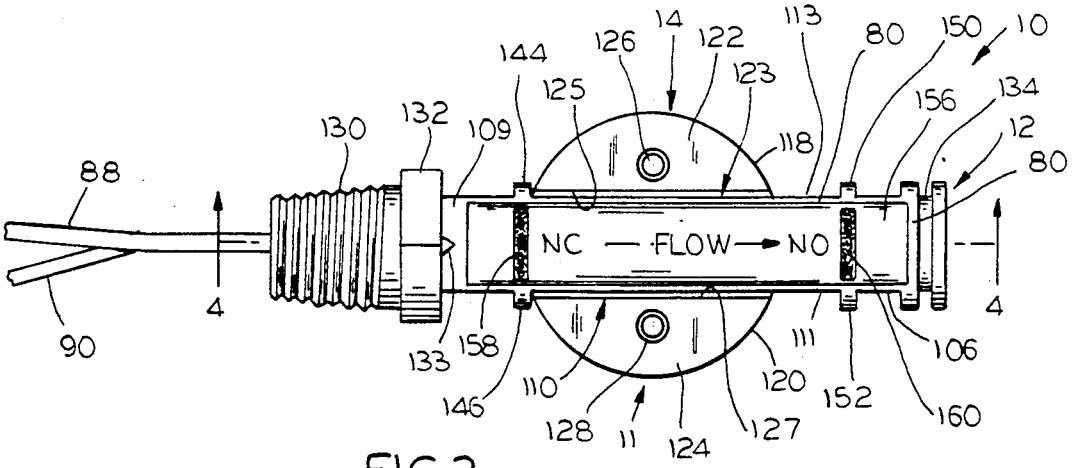
FIG. 3 is a top plan view, on a larger scale, of the fluid flow switch monitoring device shown in FIG. 1, with the cap and securing screws that clamp the unit switch assembly at a desired switch function providing position being omitted, as is the conventional Tee that is shown in FIG. 1 and with the label that is preferably applied to the side of the basic unit switch assembly facing the observer being illustrated.
Figure 5:
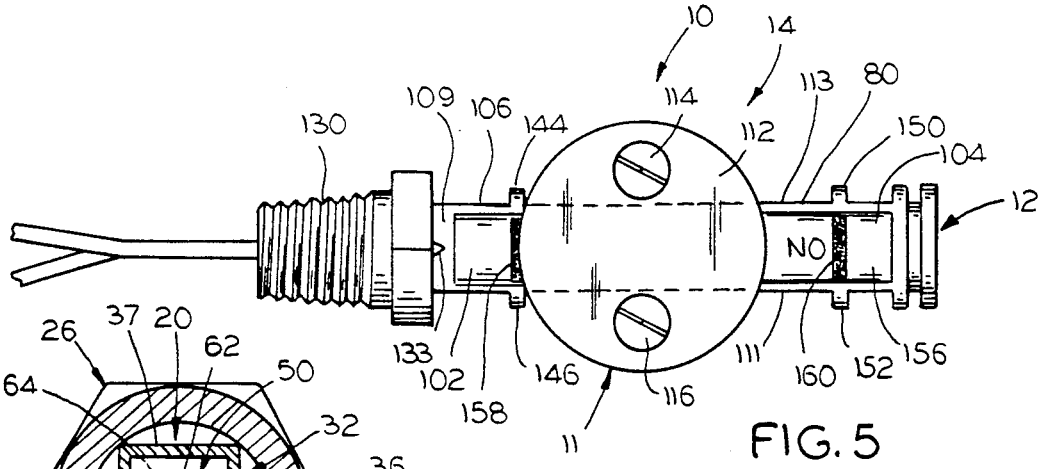
FIG. 5 is a view similar to that of FIG. 3, but with the unit sensing body cap and securing screw devices shown in position to clamp the unit switch assembly to the unit sensing body in the position indicated in FIGS. 1-3.

The housing 80 of the switch assembly 12 includes arcuate opposite side surfaces 107 and 109 (see FIGS. 1 and 4) and planar, substantially parallel, opposite side surfaces 111 and 113 (see FIG. 1, FIG. 3, and FIG. 5). The housing 80 is shiftably mounted in a slot 110, in close fitting relation thereto, formed in the closed end 24 of the sensing body 18, with the side portions 111 and 113 of the housing 80 being in substantial parallelism with the plane 123 of slot 110. Further, in accordance with the invention, the switch assembly 12 is fixed in place with regard to the sensing body 14, when the switch housing 80 has been disposed within the indicated groove 110, lengthwise of same, by applying cap 112 and its mounting screws 114 and 116 (See FIGS. 1, 2, and 5) to the sensing body 14 to clamp in the switch assembly housing 80 in fixed relation to sensing body 14. For this purpose, the slot 110 divides the end 24 of the sensing body 14 into a pair of spaced apart projections 118 and 120 that terminate in the respective planar surfaces 122 and 124 that are in coplanar relation transversely of the plane 123, with the external side surfaces 111 and 113 of housing 80 opposing the respective slot surfaces 125 and 127 defined by the respective sensing body projections 118 and 120, and the housing 80 being disposed in slot 110 so that at least a portion of its arcuate surface 109 is positioned somewhat beyond the plane 131 (see FIG. 1) of surfaces 122 and 124. Thus, housing 80 is proportioned with respect to the depth of slot 110 so that cap 112 fixes housing 80 with respect to sensing body 14 when both mounting screws 114 and 116 are turned firmly in place against same, due to a slight over spacing of the housing 80 beyond a plane (which is too insignificant to be shown in the drawing figures), as a result of the presence of arcuate side surfaces 107 and 109 on the housing 80. Further, housing 80 is oriented relative to sensing body 14 so that its side positions 111 and 113 are in substantially parallel relation with the direction of fluid flow through the piping, as indicated, for instance, by arrow 74, and as is also indicated by the oppositely disposed but identical indicia 133 and 135 (see FIGS. 3 and 5) of housing 80. Thus, by turning the respective screws 114 and 116 into the respective internally threaded apertures 126 and 128 of body 14 through the cap openings that receive the respective 114 and 116 screws until cap 112 is clamped against housing 80, the switch assembly housing 80 is "set" or mounted in fixed relation to the sensing body 14. In this connection, it is to be again noted that the groove 110 is to parallel the direction of fluid flow, and thus is parallel to the fluid flow direction indicated by indicator arrow 74, and marking indicia 133 and 135. It is also pointed out that the cap 112 external diameter is the same as that of body round portion 30.

As indicated in the drawings, the switch assembly housing 80 at its end 86 is externally threaded at 130 and is formed with a hex shaped flange at 132 for application to a housing or the like containing electrical components to which the lead wires 88 and 90 are to be connected, while the end 84 of housing 80 is shaped to define a circular indentation 134 to improve finger gripping action on the housing 80 to push or pull housing 80 for purposes of adjusting the switch assembly 12, relative to body 14, to achieve desired "switch point".

As indicated hereinbefore, the positioning of the reed switch 92 within the housing 80 is an important consideration in accordance with the present invention. The fundamental idea here is, of course, that the reed switch 92 is to be positioned within the housing 80 longitudinally of same so that when the vane assembly 50 is positioned relative to switch 92 to close same, the component parts of the assembly 10 will be in the "closed" switch functioning position of the device 10, while as long as the vane assembly 50 is positioned relative to switch 92 to permit it to be open, the component parts of the assembly 10 will be in the "open" switch functioning position of the device 10.

In accordance with this invention, opposed sides 111 and 113 of housing 80 are provided with the respective coplanar stop flanges 144 and 146, which are disposed relative to the housing 80 to engage the external surface 147 of the round portion 30 of body 14 at the open position of switch 92 relative to sensing body 14, for instance, as when these component parts are positioned as shown in FIG. 1, 2, 3, and 5. Also, the same respective sides 111 and 113 of the housing 80 are respectively formed to define the respective coplanar stop flanges 150 and 152 that are spaced from the respective flanges 144 and 146 to define the closed position of switch 92 relative to sensing body 14 when the stop flanges 150 and 152 engage opposite portion of the surface 147 of the body 18, under the same circumstances.

Further, the invention contemplates that a label 156 (not shown in reduced scale FIGS. 1 and 2, but see FIGS. 3–5) is to be applied to the arcuate side 109 of the housing 80 which has the indicia shown in FIG. 3. Thus, the label 156 (which is centered transversely of the housing side 109) defines an indicator block 158 (that may be by way of black ink) that is in parallelism with the respective stop flanges 144 and 146, as well as the same sort of indicator block 160 that is parallelism with the respective flanges 150 and 152; also, the label 156 indicates the direction of fluid flow of the device 10 and hears the indicia NC and NO that are respectively adjacent but between the respective indicator blocks 158 and 160. The label is applied to housing 80 so that the respective indicator blocks 158 and 160 have the paralleling positioning with respect to the respective sets of flanges 144, 146, and 150 and 152 that is indicated, with the result that when stop flanges 144 and 146 are in physical contact with the surface 147 of body 14, the cap 112 will overlie block 158, and when stop flanges 150 and 152 are in physical contact with the surface 147 of body 14, the cap 112 will overlie block 160. The margin of cap 112 has the same external diameter as that of the round portion 30 (of body 14) so that its marginal edging in plan is in coincidence with surface 147 of body 14, with the result that cap 112 has the same overlying relation relative to the respective blocks 158 and 160 when the respective sets of stop flanges are positioned relative to surface 147 in the manner that has been indicated.

Also, and as depicted in FIG. 2, when the housing 80 is positioned relative to sensing body 14 so that its coplanar stop flanges 144 and 146 engage the external surface 147 of the round portion 30 of the body 14, with the vane assembly 50 positioned in the no flow condition as depicted by the solid lines in FIG. 2, the device 10 is disposed in what may be considered its Normally Open (NO) setting, in which the contacts 96 and 98 of the reed switch 92 are not drawn into contact by the magnetic field of the vane magnet 54. In such Normally Open setting, when the vane assembly 50 is exposed to some fluid medium flow thereagainst, causing the vane assembly 50 to move to the position depicted by the dashed lines in FIG. 2, the switch contacts 96 and 98 are drawn together by the change in position of the magnetic field caused by the motion of the vane magnet 54, and the switch 92 is then closed.

A opposite and alternate "setting" of the device 10 is at what may be considered its Normally Closed (NC) switch function position, using flanges 150 and 152, and body surface 147, as hereinafter disclosed.

Both "settings", in accordance with the invention, may be effected by utilizing the fixing of housing 80 relative to sensing body 14, using cap 112, and screws 114 and 116 of the illustrated embodiment.

As indicated, the device 10 may also be "set" at its Normally Closed (NC) position relative to body 14, which may be obtained, assuming the device 10 is "set" at its said Normally Open (NO) position, by first loosening the cap screws 114 and 116. Once the cap 112 is freed by loosening screws 114 and 116, the switch assembly 12 can be manually repositioned longitudinally thereof and within the bounds of the opposed sides 125 and 127 (FIG. 3) of the body 14 and the cap 112, until the coplanar stop flanges 150 and 152 engage the opposite portion of the external surface 147 of the round portion 30 of body 14, after which cap 112 is retighten in place using screws 114 and 116. This new setting is considered to be the Normally Closed (NC) position because the switch assembly 12 is now located in the body 14 so that when the vane assembly 50 is positioned in the at rest or no flow condition described above, the contacts 96 and 98 of the reed switch 92 are drawn together by the magnetic field of the vane magnet 54 and the switch is closed. In this setting, assuming the application of FIGS. 1 and 2, when the vane assembly 50 is exposed to a fluid medium flow, causing the vane assembly 50 to move to the position shown by the dashed lines in FIG. 2, the magnetic field shifts as the vane magnet 54 moves and the contacts 96 and 98 move apart and the switch 92 is now open.

Thus, referring again to label 156 when the cap 112 and its securing screws 114 and 116 have been applied to affix or set the switch housing 80 in place at one of the indicated switch functioning positions, the respective label end portions and indicator blocks 158 and 160 are respectively exposed when viewing the device 10 from the end 24 of same, this giving a clear indication that the surface 147 of sensing body 14 has been physically contacted by either the flanges 114 and 146, or the flanges 150 and 152, depending on which switching function is desired for a particular application of device 10.

In the illustrated embodiment, the label 156 indicia is thus oriented so that when flanges 144 and 146 engage surface 147, the NO block indicator 160 is fully exposed for reading, while when flanges 150 and 152 engage surface 147, the NC block indicator 158 is fully exposed for reading. The NO indicia of label 156 adjacent block 160 means that switch assembly 12 is in its Normally Open position, which the NC indicia of label 156 adjacent block 158 means that the switch assembly 12 is in its Normally Closed position.

The switch assembly 12 is thus arranged so that, as viewed from the end 24 of sensing body 14, the label indicia NO or NC that is fully visible positively indicates the Normally Open or Normally Closed condition of the switch as it may be "set", with either set of stop flanges 144, 146 or 150, 152 in physical contact with surface 147. Further, the marginal edging of the cap 112 is seated over the indicator block 158 or 160 that is involved. For instance, in the showing of FIG. 5, it is clear that the switch assembly 12 is in its Normally Open position relative to sensing body 14 (in the Normally Closed position the cap 112 would expose the NC indicia and cover the NO indicia of label 156).

Operation of the monitoring device 10 is simple and dependable. In most applications, the switch assembly 12 is to be set in the Normally Open position as shown in FIG. 5, so that when there is a flow of liquid, gas or air at a predetermined excess flowrate, the contacts close and a circuit is complete. As the flow slows or stops, the vane spring 58 moves the vane asembly 50 back to the at rest position and the contacts of the reed switch 92 are returned to the initial open position. With simple wiring configurations, the monitoring device can be used to activate an alarm or signal, or operate a damper or valve. Coupled with an isolation relay, device 10 can also be used to start and stop motors, pumps or engines. It can be relied on to monitor and protect unattended equipment from damage. By changing the position of the switch assembly 12 to the Normally Closed position, as described previously, another vast number of possible control uses is created.

When installing the unit 10 into smaller pipe sizes, it is likely that the vane portion 52 will need to be "in field" cut to prevent the vane assembly 50 from binding on the walls of the fitting involved. A template may be provided to mark the appropriate point for cutting the vane portion 52, depending on the size of the pipe to which the device 10 is to be applied.

It is recommended that the device 10 be suitably applied to pipelines having internal diameters of approximately one half (½) inch to approximately two (2) inches.

The monitor 10 is surprisingly compact, is solidly built, and is designed for years of trouble free service in critical operations. The sensing body 14 is made solid and non-porous from end-to-end, and thus in leakproof, preventing the pipeline fluid mediums from contacting the switch assembly 12. The monitor 10 is free of mechanical leakage, with the sole moving part being concerned with the vane assembly 50 and the components it carries including the vane 52 and the magnet 54. Depending on the manner of use, which is at the option of the installer, as the fluid flow increases or decreases, the magnet 54 moves, and with end 24 of the sensing body 14 and the switch assembly 12 being sufficiently permeable to the magnetic field of the magnet, effects closure or opening of the hermetically sealed reed switch 92 of the switch assembly 12, which switch assembly 12 incidentally is located exteriorly of the sensing body 14. The activation of the switch assembly 12 is adjustable since the switch assembly 12 can be moved to cause the reed switch 92 to be positioned as desired for either Normally Open or Normally Closed switch function service, and at the option of the installer, depending, for instance, on the use to which the device 10 is to be put. This permits the monitoring device 10 to be calibrated to "trigger" on either rising or falling of the fluid medium flow rates, as they may be required in the specific application employed, and the switch assembly 12 involved is arranged to provide a physical indication that the switch assembly 12 is precisely located at its Normally Open or Normally Closed positions relative to the monitor sensing body, for sure operation at the desired positioning at same. Further, maintenance and calibration of the monitor device 10 are obviously easily effected.

Also, the switch assembly 12 is readily calibrated or removed entirely from the sensing body 14 for inspection or replacement, without shutting down the pipeline to which the device 10 has been applied.

It is recommended that a full size trimmable stainless steel vane be provided together with a removable laminate template, in association with the remaining component parts of the monitor 10, where in field installation is contemplated. The monitoring device 10 is also ideally suited for OEM work, as one device 10 can be stocked and used for a variety of applications.

The foregoing description and drawings are given merely to explain and illustrate the invention, and the invention is not to be limited thereto, except so far as the appended claims are so limited, since those skilled in the art who have this disclosure before them will be able to make modifications and variations therein without departing from the scope of the invention.

What is claimed is:

1. In a fluid flow monitoring assembly that includes an elongate sensing body adapted for crosswise application at one end thereof to and into a conduit through which the fluid to be monitored is to flow, with the sensing body being formed from non-magnetic material to define a bore extending longitudinally thereof that is open at one end thereof and that is closed at the other end thereof, and with the sensing body cross mounting at its closed end an elongate reed type off-on switch device for adjustment movement longitudinally laterally of the body between Normally Closed (NC) and Normally Open (NO) switching function positions, and with the sensing body pivotally mounting in its bore, for pivot movement in a plane that is in substantial coplanar relation to the direction of fluid flow through the conduit, a vane assembly that includes at one end of same a vane projecting from the body open end and a permanent magnet adjacent the other end of the vane assembly disposed adjacent the sensing body closed end for effecting by magnetic action the activation of the switch device to its desired switching function position, spring means mounted within the sensing body for resiliently opposing such pivotal action of the vane assembly, and means for clamping the switch device into fixed relation with the sensing body, the improvement wherein:

the switch device comprises an elongate housing defining an elongated bore intermediate the ends thereof, a reed switch mounted in said housing bore in electrical circuit arrangement with lead wires extending from one of end of said housing, with said reed switch being disposed on the side of said housing that has a level that is closest to the path movement of the magnet on pivotal movement of the vane assembly, said side of said housing being the switch side of said housing, said housing defining first and second stop means disposed one on either side of the sensing body for physical engagement with the sensing body, respectively, when the switch device is to be positioned to indicate the Normally Closed and Normally Open switch function positions of said reed switch, respectively, with said reed switch being positioned longitudinally in said housing to have its Normally Closed function when said housing first stop means engages the sensing body, and with said housing have the side of same opposite that of said switch side bearing indicia corresponding to the location of said first and second stop means.

2. The improvement set forth in claim 1 wherein:
the said first and second stop means each comprise oppositely directed flanges projected oppositely from the respective sides of said housing that are intermediate said switch side and said opposite sides of said housing.

3. The improvement set forth in claim 1 wherein:
said indicia is applied to label means for indicating the positioning of said reed switch at either of said switch function positions thereof when said switch device is shifted longitudinally thereof to separately bring the respective first and second stop means into physical engagement with the sensing body.

4. The improvement set forth in claim 1 wherein:
the sensing body exterior includes indicia means for orienting same relative to the conduit for directing the fluid flow against the vane when the assembly is to monitor the fluid flow therein.

5. The improvement set forth in claim 3 wherein:
said means for clamping the switch device into fixed position in relation with the sensing body comprises:
the sensing body at its closed end being formed with a slot thereacross for slidably receiving the switch device with the said switch side of said housing riding in said slot at said level,
said slot paralleling the pivotal movement plane of the van assembly, and
including a cap and screw means for clamping the switch device into fixed relation with the sensing body.

6. In a fluid flow monitoring assembly that includes an elongate sensing body adapted for crosswise application at one end thereof to and into a conduit through which the fluid to be monitored is to flow, with the sensing body being formed from non-magnetic material to define a bore extending longitudinally thereof that is open at one end thereof and that is closed at the other end thereof, and with the sensing body cross mounting at its closed end and elongate reed type off-on switch assembly for adjustment movement longitudinally laterally of the body between Normally Closed (NC) and Normally Open (NO) switching function positions, and with the sensing body pivotally mounting in its bore, for pivot movement in a plane that is in substantial coplanar relation to the direction of fluid flow through the conduit, a vane assembly that includes at one end of same a vane projecting from the body open end and a permanent magnet adjacent the other end of the vane assembly disposed adjacent the sensing body closed end for effecting by magnetic action the activation of the switch assembly to its desired switching function position, spring means mounted within the sensing body for resiliently opposing such pivotal action of the vane assembly, and means for clamping the switch assembly into fixed relation with the sensing body,
the method including:
forming the switch assembly for stopping its adjusting movement to provide a positon indication of when the switch device is disposed relative to the sensing body to provide alternate Normally Closed and Normally Open switch function positions,
providing indicia on the exterior of the switch assembly that indicates such positions,
and setting the switch assembly at one of said positions.

7. The method set forth in claim 6 including:
alternately setting the switch assembly at the other of said positions.

* * * * *